US008382551B2

(12) United States Patent
Hong

(10) Patent No.: US 8,382,551 B2
(45) Date of Patent: Feb. 26, 2013

(54) TOY FIGURE WITH MOTION FEATURES

(75) Inventor: Brian Hong, Valencia, CA (US)

(73) Assignee: Mattel, Inc., El Segundo, CA (US)

( * ) Notice: Subject to any disclaimer, the term of this patent is extended or adjusted under 35 U.S.C. 154(b) by 393 days.

(21) Appl. No.: 12/690,520

(22) Filed: Jan. 20, 2010

(65) Prior Publication Data

US 2011/0130070 A1 Jun. 2, 2011

Related U.S. Application Data

(60) Provisional application No. 61/265,269, filed on Nov. 30, 2009.

(51) Int. Cl.
*A63H 3/46* (2006.01)

(52) U.S. Cl. ..... 446/376; 446/384; 446/391; 446/390; 40/419

(58) Field of Classification Search ..... 446/376, 446/353–354, 375, 330, 236, 333–340, 371, 446/391, 390, 321, 384; 40/418–419; *A63H 3/20, A63H 11/00, 13/00*

See application file for complete search history.

(56) References Cited

U.S. PATENT DOCUMENTS

| | | | | |
|---|---|---|---|---|
| 711,510 | A | 10/1902 | Little | |
| 711,511 | A | 10/1902 | Little | |
| 1,243,152 | A * | 10/1917 | Fusch | 446/267 |
| 1,576,789 | A * | 3/1926 | Robertson | 446/354 |
| 1,693,157 | A | 11/1928 | Rauffus | |
| 2,137,371 | A * | 11/1938 | Marsh | 446/330 |
| 2,235,636 | A | 3/1941 | Herte | |
| 2,310,037 | A | 2/1943 | Reno | |
| 2,540,484 | A * | 2/1951 | Kellner | 446/365 |
| 2,633,651 | A | 4/1953 | Nelson et al. | |
| 2,639,547 | A | 5/1953 | Adler | |
| 2,648,161 | A * | 8/1953 | Stewart | 446/330 |
| 2,669,064 | A * | 2/1954 | Stewart | 446/330 |
| 2,686,388 | A | 8/1954 | Seidl | |
| 2,700,846 | A | 2/1955 | Coe | |
| 3,054,215 | A | 9/1962 | Neumann | |
| 3,063,192 | A | 11/1962 | Ayala | |
| 3,094,331 | A | 6/1963 | Greene | |
| 3,147,566 | A * | 9/1964 | Ong | 446/359 |
| 3,264,779 | A * | 8/1966 | Bonanno | 446/354 |
| 3,419,994 | A | 1/1969 | Glass et al. | |
| 3,444,645 | A | 5/1969 | Tepper et al. | |
| 3,456,950 | A * | 7/1969 | Goldfarb | 273/161 |
| 3,475,853 | A * | 11/1969 | Adler | 446/330 |
| 3,477,169 | A | 11/1969 | Gardel et al. | |
| 3,494,068 | A | 2/1970 | Crosman | |
| 3,494,323 | A * | 2/1970 | Kripak et al. | 116/139 |

(Continued)

FOREIGN PATENT DOCUMENTS

| | | |
|---|---|---|
| EP | 0855204 B1 | 3/2003 |
| GB | 2279885 A | 1/1995 |

(Continued)

*Primary Examiner* — Gene Kim
*Assistant Examiner* — Matthew B Stanczak
(74) *Attorney, Agent, or Firm* — Edell, Shapiro & Finnan LLC

(57) ABSTRACT

A toy figure with a movable appendage and a movable head is disclosed. The appendage is coupled to a movement mechanism such that movement of the appendage results in movement of the head. Depending on the particular quantity of appendage movements, the head is moved to the side or tilted forward as the appendage is moved relative to the body of the toy figure.

20 Claims, 11 Drawing Sheets

U.S. PATENT DOCUMENTS

| | | | | | |
|---|---|---|---|---|---|
| 3,571,967 | A | | 3/1971 | Glass et al. | |
| 3,603,029 | A | | 9/1971 | Nutting | |
| 3,648,405 | A | * | 3/1972 | Tepper | 446/330 |
| 3,650,065 | A | | 3/1972 | Johmann | |
| 3,672,096 | A | | 6/1972 | Johmann | |
| 3,684,291 | A | | 8/1972 | Johmann | |
| 3,728,816 | A | * | 4/1973 | Ensmann et al. | 446/336 |
| 3,754,351 | A | * | 8/1973 | Glass et al. | 446/338 |
| 3,779,556 | A | | 12/1973 | Johmann | |
| 3,841,020 | A | | 10/1974 | Ryan et al. | |
| 3,851,418 | A | | 12/1974 | Barlow et al. | |
| 3,858,353 | A | | 1/1975 | Glass et al. | |
| 3,911,614 | A | | 10/1975 | Terzian | |
| 4,071,249 | A | * | 1/1978 | Goldfarb et al. | 273/161 |
| 4,126,961 | A | * | 11/1978 | Barlow et al. | 446/359 |
| 4,188,746 | A | * | 2/1980 | Wolf | 446/198 |
| 4,518,367 | A | | 5/1985 | Zaruba et al. | |
| 4,578,045 | A | | 3/1986 | Mayer et al. | |
| 4,601,672 | A | | 7/1986 | Cook et al. | |
| 4,608,026 | A | * | 8/1986 | Newton et al. | 446/330 |
| 4,623,319 | A | | 11/1986 | Zaruba et al. | |
| 4,657,518 | A | * | 4/1987 | Kelley et al. | 446/354 |
| 4,840,597 | A | | 6/1989 | Perez | |
| 4,968,280 | A | * | 11/1990 | Kelley | 446/330 |
| 5,087,219 | A | | 2/1992 | Price | |
| 5,125,865 | A | | 6/1992 | Orenstein et al. | |
| 5,147,238 | A | | 9/1992 | Kelley et al. | |
| 5,906,531 | A | * | 5/1999 | Llorens | 446/340 |
| 6,022,263 | A | * | 2/2000 | Liu et al. | 446/379 |
| 6,547,632 | B2 | * | 4/2003 | Marine et al. | 446/354 |
| 6,565,407 | B1 | * | 5/2003 | Woolington et al. | 446/175 |
| 7,537,506 | B2 | * | 5/2009 | de la Torre | 446/353 |
| 7,942,720 | B1 | | 5/2011 | Galoustian | |
| 2006/0292965 | A1 | * | 12/2006 | Strauss | 446/376 |
| 2009/0215358 | A1 | * | 8/2009 | Moothedath et al. | 446/139 |

FOREIGN PATENT DOCUMENTS

| | | | |
|---|---|---|---|
| GB | 2279886 | A | 1/1995 |

* cited by examiner

TOY FIGURE WITH MOTION FEATURES

CROSS-REFERENCE TO RELATED APPLICATION

This application claims priority to and the benefit of U.S. Provisional Patent Application No. 61/265,269, filed Nov. 30, 2009, entitled "Toy Figure with Motion Features," the entire disclosure of which is incorporated herein by reference in its entirety.

FIELD OF THE INVENTION

The present invention relates to a toy figure including motion features.

BACKGROUND OF THE INVENTION

In a toy figure for children, life-like features for the toy figure (or doll) generate interest for children. Thus, some types of dolls and toy figures include movable limbs or other appendages. Some toy figures include a mechanism that moves a limb or appendage of a toy figure. For example, manual movement mechanisms typically use an indirect movement, that is to say one or more limbs are movably supported upon the toy figure such as arms or legs while an additional movable actuator or lever is positioned elsewhere on the toy figure. A mechanism links the movement of the actuator to the movable limb, generating the desired movement as the actuator is manipulated. By way of further example, manipulation of one limb or appendage may cause a corresponding motion in another part of the toy figure.

The realistic motion of the appendages enhances the play value of the toy figure. Thus, it would desirable to provide an interactive toy with realistic motion capabilities.

SUMMARY OF THE INVENTION

The present invention is directed toward a doll or toy figure including a drive mechanism operable to move one or more portions of the figure. The drive mechanism may be configured to generate a predetermined motion pattern when engaged. By way of example, the drive mechanism may be configured to generate a nod, i.e., a forward bending and/or up-and-down movement of the head.

BRIEF DESCRIPTION OF THE DRAWINGS

Like reference numerals have been used to identify like elements throughout this disclosure.

DETAILED DESCRIPTION OF THE INVENTION

The terms "limb," "arm," and "appendage" are used interchangeably herein. The terms "doll" and "toy figure" are used interchangeably herein.

Figure 1:
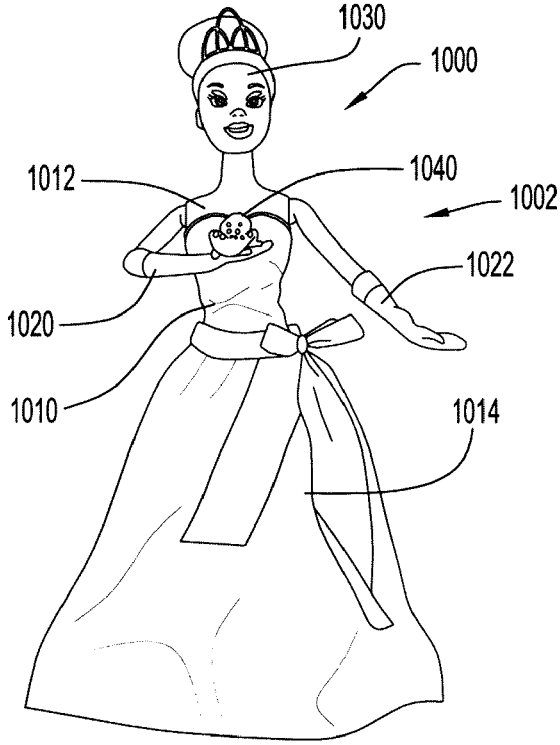
FIG. 1 illustrates a front view of an embodiment of a toy figure in a first configuration.
Figure 2:
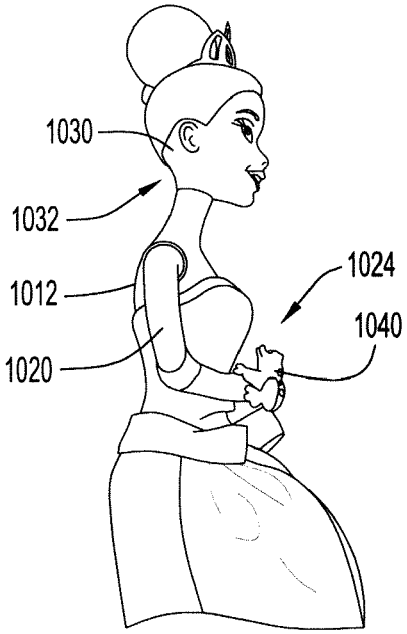
FIGS. 2 and 3 illustrate side views of the toy figure illustrated in FIG. 1.
Figure 3:
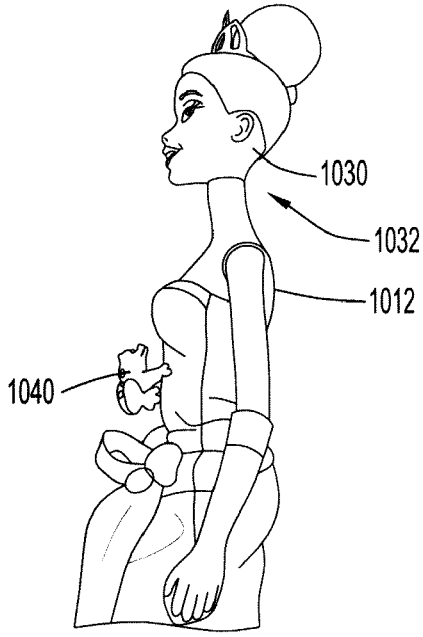

An embodiment of a toy figure is illustrated in FIGS. 1-9. Referring to FIGS. 1-3, front and side views of the toy FIG. 1000 are illustrated. The toy FIG. 1000 includes a body 1010 with a torso 1012, a pair of legs (not shown), and a pair of arms or appendages 1020 and 1022. In this embodiment, the toy FIG. 1000 includes a dress 1014 that is mounted to the torso 1012. The toy FIG. 1000 resembles a princess in this embodiment.

Each of the appendages 1020, 1022 is movable relative to the torso 1012. Appendage 1022 is pivotable in many directions in a conventional manner. Appendage 1020, however, is movable between a lowered position and a raised position relative to the torso 1012. Referring to FIGS. 1-3, appendage 1020 is illustrated in a lowered position 1024 relative to the torso 1012.

In this embodiment, a toy object 1040 is coupled to the appendage 1020. In particular, the toy object 1040 is a toy character, such as a frog, that is located proximate to the hand of the appendage 1020.

The toy FIG. 1000 also includes a head 1030 that is movable between multiple positions relative to the torso 1012. Referring to FIGS. 1-3, the head 1030 is disposed in a forward looking position.

Figure 4:
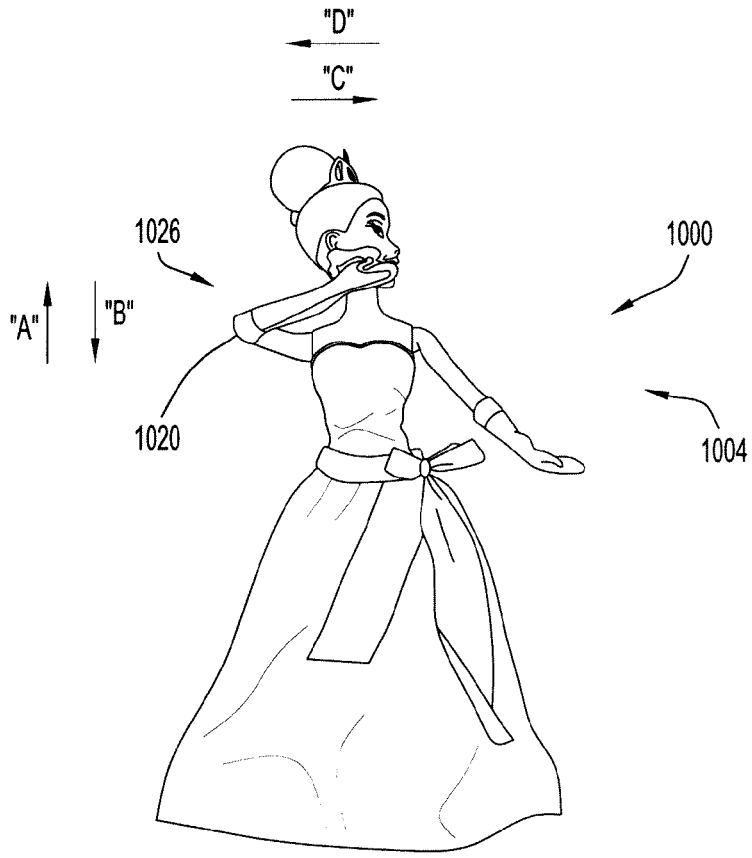
FIG. 4 illustrates a front view of the toy figure illustrated in FIG. 1 in a second configuration.
Figure 5:
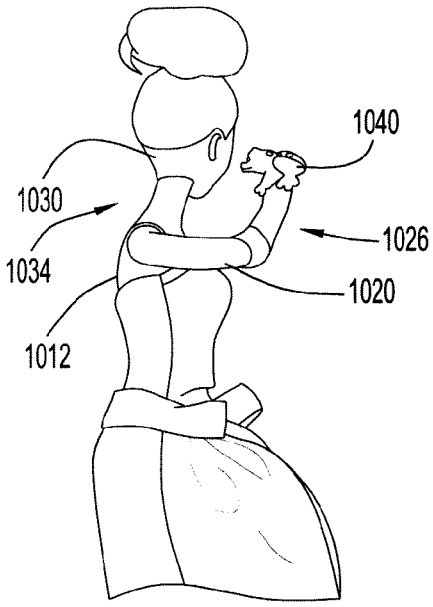
FIGS. 5 and 6 illustrate side views of the toy figure illustrated in FIG. 4.
Figure 6:
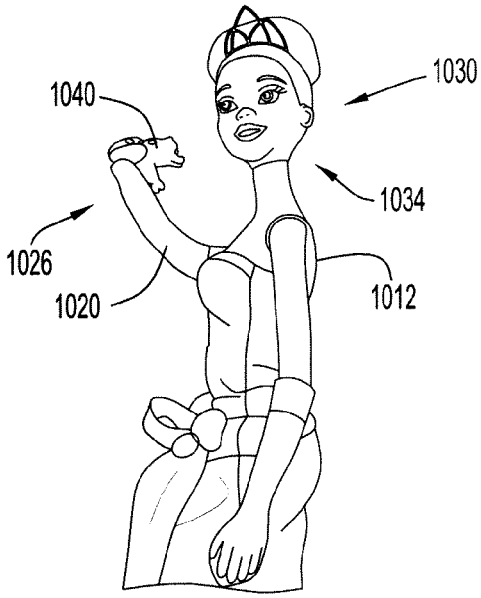

Referring to FIGS. 4-6, front and side views of the toy FIG. 1000 in another configuration 1004 are illustrated. As shown, the appendage 1020 has been moved along the direction of arrow "A" to its upper or raised position 1026. The appendage 1020 and the toy object 1040 are located close to the head 1030 of the toy figure when the appendage 1020 is in its upper position 1026. However, as the appendage 1020 moves from its lowered position 1024 to its raised position 1026, the head 1030 simultaneously moves from its forward position 1032 (shown in FIGS. 1-3) to a position 1034 facing or oriented to the side of the toy FIG. 1000 and the torso 1012. In particular, the head 1030 is rotated about a substantially vertical axis along the direction of arrow "C" to its side oriented position 1034.

As shown in FIGS. 4-6, the head 1030 of the toy FIG. 1000 is turned away from the appendage 1020 and the toy object 1040 when the head 1030 is in its side position 1034. In this manner, when the appendage 1020 and the toy object 1040 are raised toward the head 1030 of the toy FIG. 1000, the head 1030 moves or turns away to the side to avoid the appendage 1020 and the toy object 1040.

When the user moves the appendage 1020 downward along the direction of arrow "B" to its lowered position 1024 (shown in FIGS. 1-3), the head 1030 rotates along the direction of arrow "D" to its forward position 1032.

Figure 7:
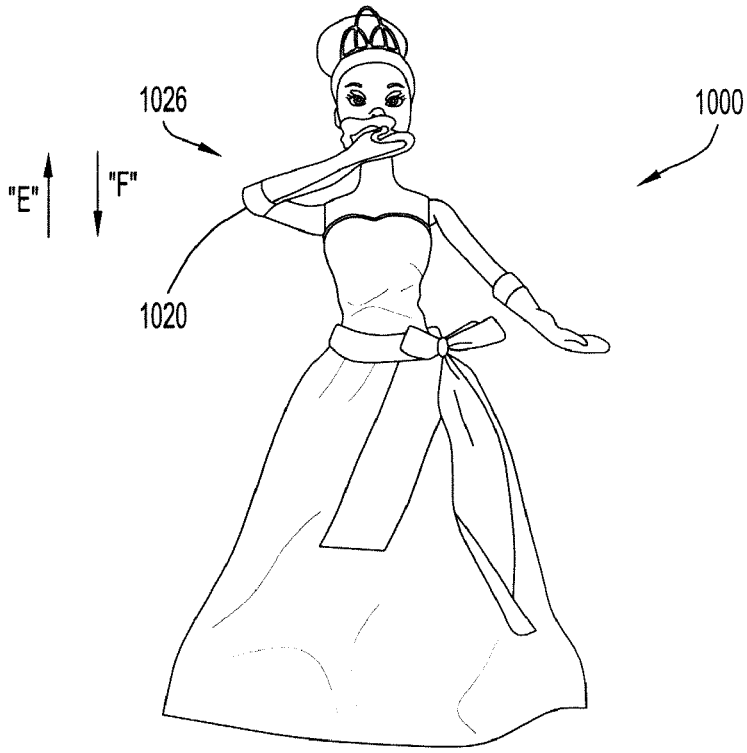
FIG. 7 illustrates a front view of the toy figure illustrated in FIG. 1 in a third configuration.
Figure 8:
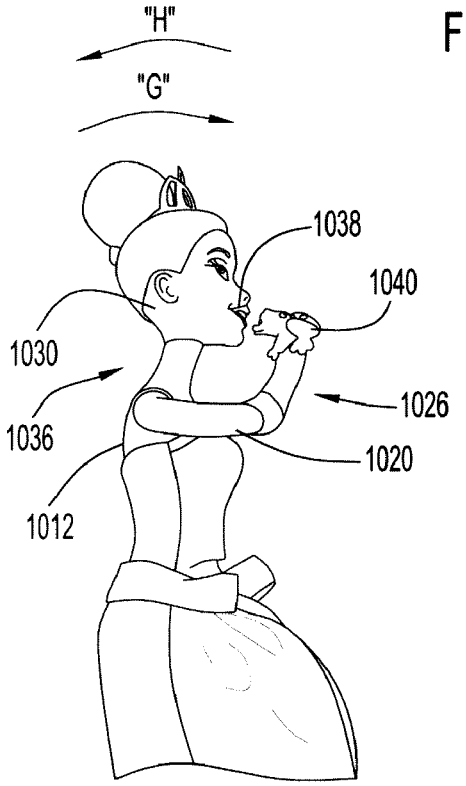
FIGS. 8 and 9 illustrate side views of the toy figure illustrated in FIG. 7.
Figure 9:
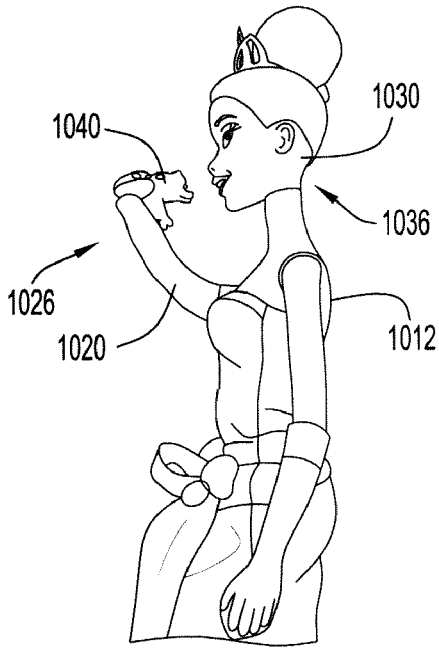

Referring to FIGS. 7-9, front and side views of the toy FIG. 1000 in another configuration 1006 are illustrated. In this configuration 1006, the appendage 1020 is moved by a user along the direction of arrow "E" to its raised position 1026.

This movement of appendage 1020 results in the head 1030 moving along the direction of arrow "G" to a forward tilting or tilted position 1036. In this position 1036, the mouth 1038 of the head 1030 is located proximate to the toy object 1040 such that the toy FIG. 1000 appears to be kissing the toy object 1040.

When the appendage 1020 is moved downward along the direction of arrow "F," the head 1030 moves along the direction of arrow "H" to its forward oriented position 1032.

Figure 10:
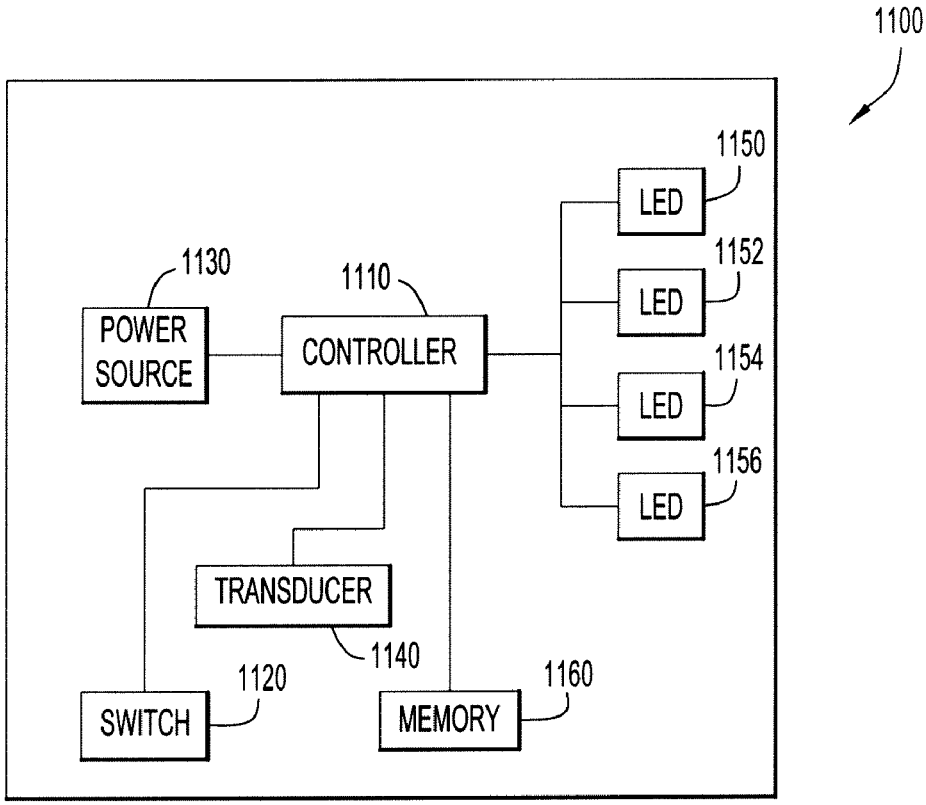
FIG. 10 illustrates a schematic diagram of an electronic system for the toy figure illustrated in FIG. 1.
Figure 11:
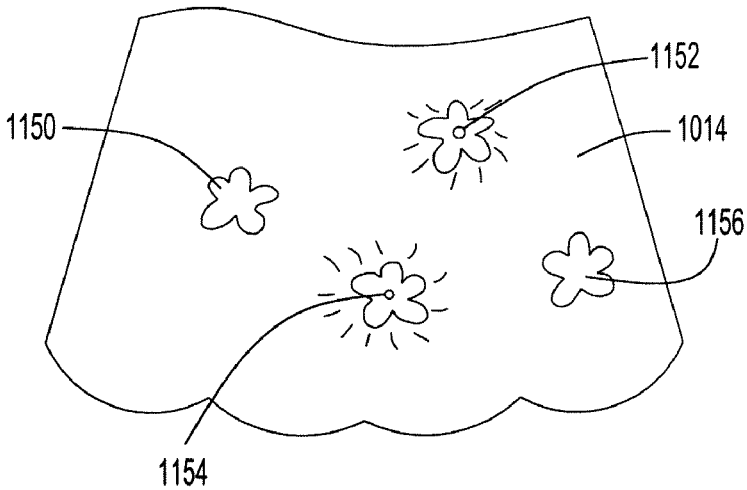
FIG. 11 illustrates a front view of the dress of the toy figure illustrated in FIG. 1.

Referring to FIG. 10, a schematic diagram of the electronic system is illustrated. In this embodiment, the electronic system 1100 includes a controller 1110 that is connected to a switch 1120 that is activated when the appendage 1020 of the toy FIG. 1000 is moved from its lowered position 1024 to its raised position 1026. A power source 1130, such as three button cell batteries, is used to provide power to the system 1100. In this embodiment, the power source 1130 is located inside of a leg of the toy FIG. 1000. The electronic system 1100 also includes a transducer 1140, such as a speaker, that generates audible outputs in response to the closing or activating of the switch 1120. In addition, the system 1100 also includes several light output devices, such as LEDs 1150, 1152, 1154, and 1156, that are illuminated after a selected movement of the appendage 1020, as described in greater detail below. In one embodiment, the LEDs 1150, 1152, 1154, and 1156 are different colors and coupled to the dress 1014 such that the LEDs 1150, 1152, 1154, and 1156 are visible through the dress 1014 when illuminated (see FIG. 11).

An exemplary use of the toy FIG. 1000 is described with respect to FIGS. 1-11. Initially, the appendage 1020 is located in its lowered position 1024 and the head 1030 is located in its forward looking or oriented position 1032 as shown in FIGS. 1-3. The user moves the appendage 1020 upward from its lowered position 1024 to its raised position 1026. The movement of the appendage 1020 closes the switch 1120 and an audible output is generated. In one embodiment, the audible output is a voice that is associated with the toy object 1040, which is a frog. The audible output also includes an output associated with the toy FIG. 1000 that simulates a response to the toy object's output.

As the appendage 1020 moves from its lowered position 1024 to its raised position 1026, the head 1030 moves from its forward looking position to its side oriented position, so as to avoid contact with the toy object 1040 coupled to the appendage 1020. For example, when the toy object 1040 is a frog, the audible output associated with the toy object 1040 may be the frog asking the toy FIG. 1000, which in this embodiment is a princess resembling character, for a kiss. The movement of the head 1030 of the toy FIG. 1000 to avoid contact with the toy object 1040 and in particular, avoid kissing the toy object 1040, occurs about the same time as the audible output associated with the toy FIG. 1000 declines the advances of the toy object 1040. The output generation ceases after the toy figure's audible output. The user can move the appendage 1020 back down to its lowered position 1024, which causes the head 1030 to move back to its forward oriented position 1032. The user can move the appendage 1020 either during or after the generation of the outputs.

The user can then move the appendage 1020 upward to its raised position 1026 for a second time, which causes the head 1030 to move to its side position 1034 again. This second or subsequent movement of the appendage 1020 closes the switch 1120 again, thereby resulting in the generation of another audible output associated with the toy object 1040 and another audible output associated with the toy FIG. 1000 in response to the toy object 1040. The user can move the appendage 1020 back down to its lowered position 1024, which causes the head 1030 to move back to its forward position 1032.

The appendage 1020 can be moved upward to its raised position 1026 for a third time, causing the head 1030 to move to the side position 1034 again. Another set of audible outputs associated with the toy object 1040 and the toy FIG. 1000 are generated. The user can then move the appendage 1020 back down to its lowered position 1024, which causes the head 1030 to move back to its forward position 1032.

The appendage 1020 can be moved upward to its raised position 1026 for a fourth time, causing the head 1030 to move from its forward position 1032 to its tilted position 1036 (as shown in FIGS. 7-9). In this position 1036, the mouth 1038 of the toy FIG. 1000 is located proximate to the toy object 1040, thereby simulating a kiss from the toy FIG. 1000 to the toy object. The audible outputs generated by the closing of the switch 1120 a fourth time include an output associated with the toy object 1040 and an acquiescence of the toy FIG. 1000 to a kiss. Upon the completion of that output, the electronic system 1100 generates a musical output and illuminates the LEDs 1150, 1152, 1154, and 1156 in a random pattern. In one embodiment, the audible outputs generated by the electronic system are preprogrammed and stored in the memory 1060.

Figure 12:
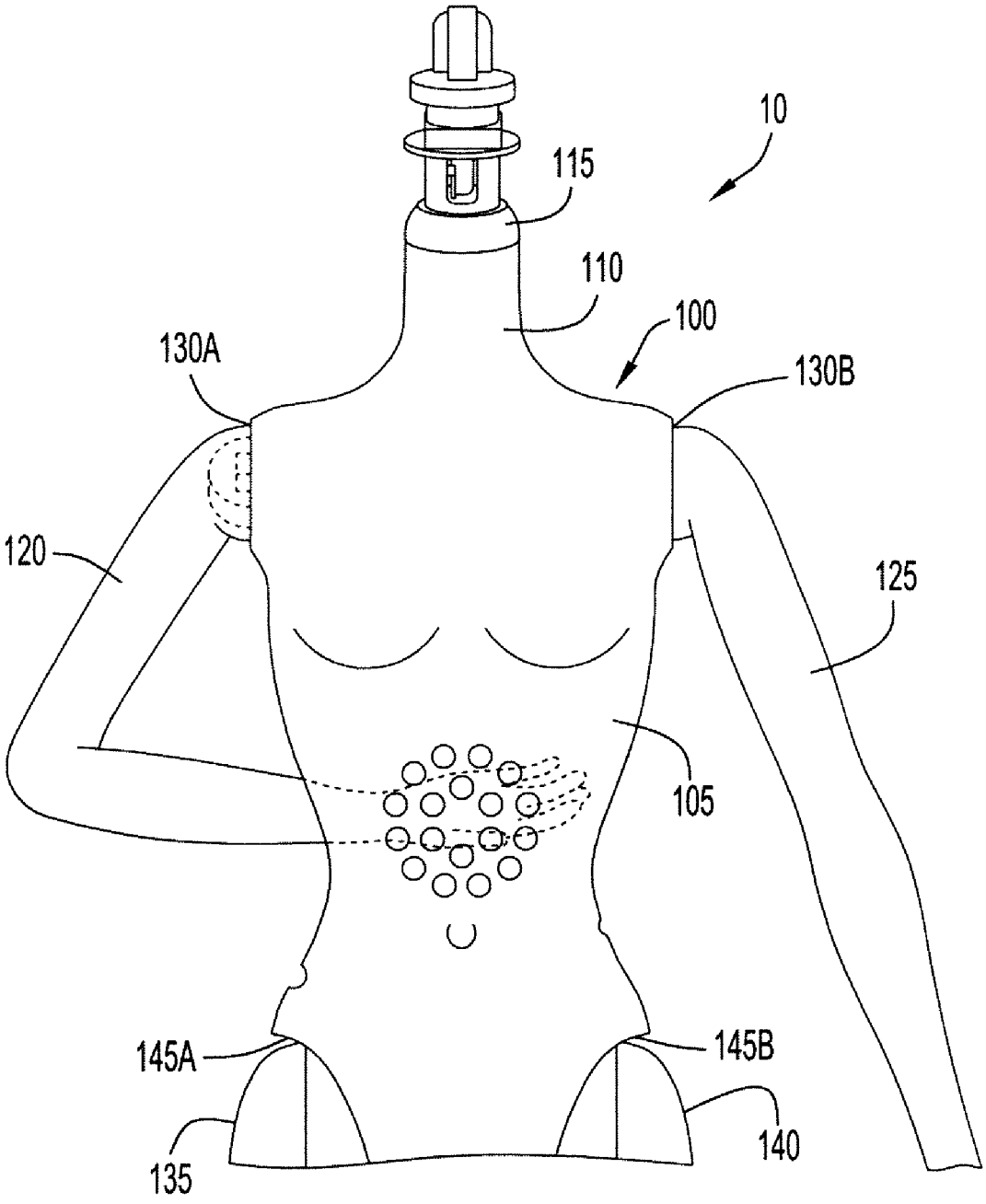
FIG. 12 illustrates a front view of an embodiment of a toy figure in a first configuration.

FIG. 12 is a perspective view of a toy figure or doll in accordance with an embodiment of the present invention. As shown, the toy FIG. 10 is stylized as a human figure and includes a torso 100 with a trunk portion 105 and a neck portion 110 that defines a neck socket 115, a first upper limb or arm 120, a second upper limb or arm 125, and a head (not illustrated for clarity). The limbs or arms can be referred to alternatively as appendages. The arms 120, 125 are rotatably coupled to the torso 100 via generally aligned upper torso sockets 130A, 130B. The toy FIG. 10 further includes a first lower limb or leg 135 and a second lower limb or leg 140, each of which is rotatably coupled to the torso 100 via generally aligned lower torso sockets 145A, 145B.

Figure 13:
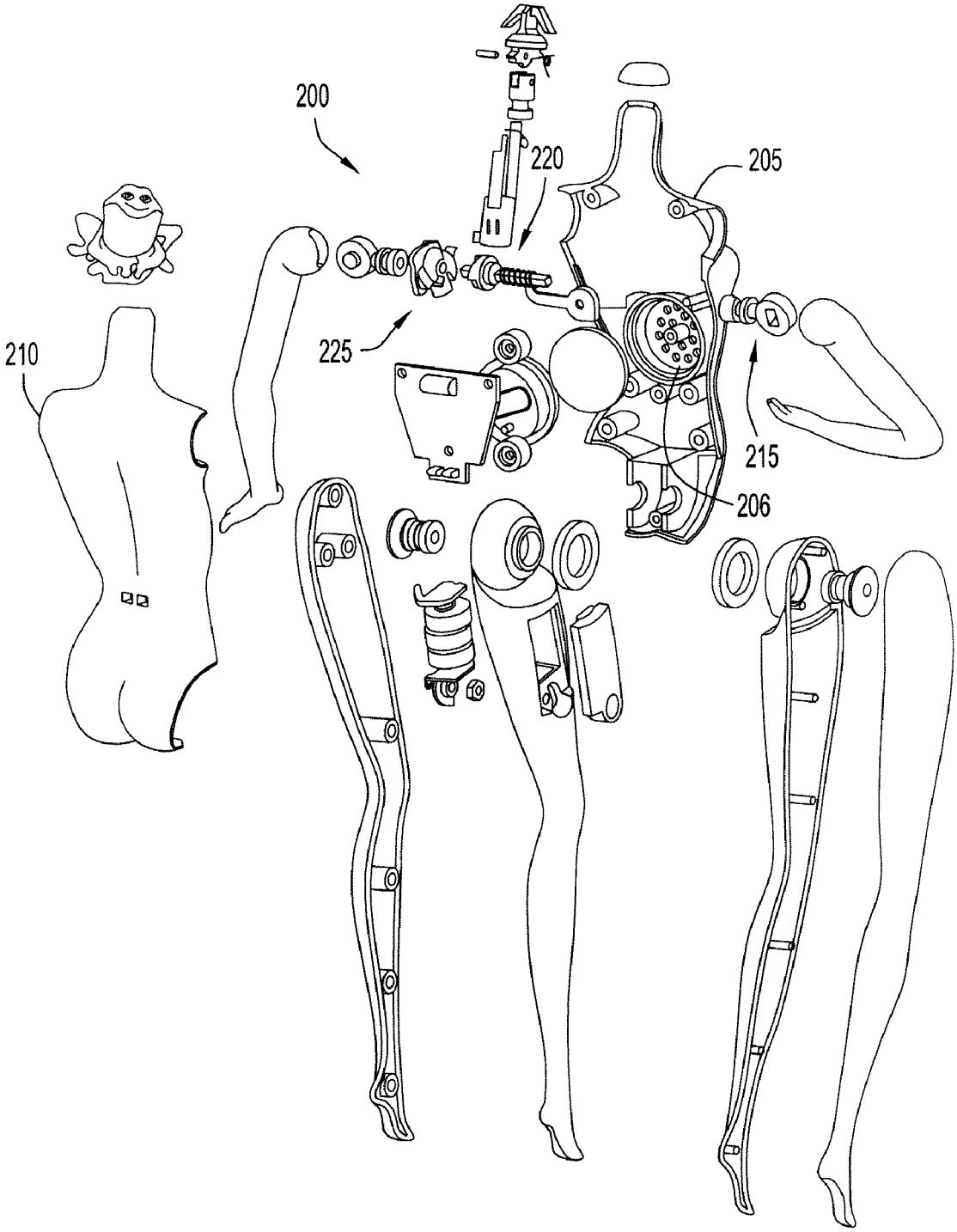
FIG. 13 illustrates an exploded perspective view of the components of the toy figure illustrated in FIG. 12.

FIG. 13 illustrates an exploded view of the toy figure of FIG. 12. As illustrated, the torso 100 includes a torso front section 205, with speaker holes 206, and a torso rear section 210. The torso 100 houses a movement mechanism 200 that uses motion of one part of the toy figure to move another part of the toy figure. The movement mechanism 200 is configured so that pivoting the first arm 120 about the axis of its associated upper torso socket 130 generates a head turning and/or head canting or tilting motion. The drive mechanism includes an arm gear 215 including a clutch assembly including a first clutch 220 and a second clutch 225. The clutches 220 and 225 engage each other as described below.

Figure 14:
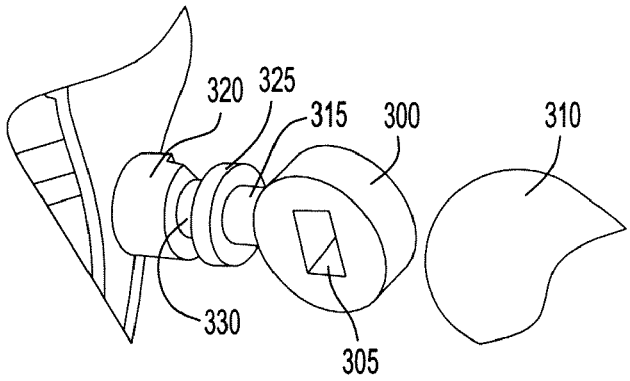
FIGS. 14-17 illustrate exploded views of some of the components of the toy figure illustrated in FIG. 12.

The first arm 120 is coupled to the arm gear 215 that is pivotally supported within the torso. The arm gear 215 rotates about a generally horizontal socket axis. Referring to FIG. 14, the arm gear 215 includes a disk-shaped arm flange 300 with an aperture 305. The disk-shaped arm flange 300 is configured to mate with a slot disposed at the proximal end of the first arm 120 (i.e., in the shoulder ball 310). A central shaft 315 extends from the disk shaped arm flange 300. The shaft 315 includes a flange 320 longitudinally spaced from another flange 325. The flanges 320, 325 define a guide rail 330 that receives and rides along tabs formed into the front torso section 205 (discussed in greater detail below).

Figure 15:
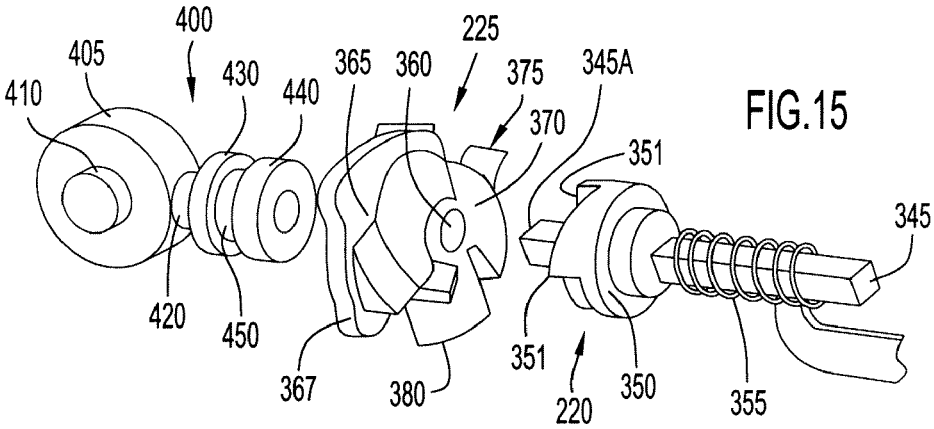

Referring back to FIG. 13, the arm gear 215 is in communication with the clutch assembly. Specifically, the distal end of the arm gear 215 has an aperture keyed to mate with the first clutch 220, which, in turn, is in communication with the second clutch 225. As shown, in FIG. 15, the first clutch 220 includes a shaft 345 with a plate 350 disposed proximate an end of the shaft 345. The shaft 345 is coupled to the arm gear 215 such that rotation of the arm gear 215 causes a corresponding rotation of the first clutch 220. The plate 350 is biased toward the second clutch 225 via a biasing member 355 (such as a spring) disposed about the shaft 345. The plate 350 includes several teeth 351 spaced apart that engage the second clutch 225.

The second clutch 225 includes a female portion 360 and a male portion 365. The female portion 360 of the second clutch 225 selectively mates with the plate 350 of the first clutch 220. The female portion 360 of the second clutch 225 includes a central aperture 370 that receives an end 345A of the shaft 345. When the user moves the arm 120 upward, the male portion 365 of the second clutch 225, which is coupled to the axle 345, rotates relative to and slides along the female portion 360 of the second clutch 225 until the male and female portions are operatively engaged with each other. When the user moves the arm 120 downward, the male portion 365 drives the female portion 360 for a quarter of a full rotation. In alternative embodiments, the amount of rotation of the second clutch 225 and in particular, the female portion 360, can vary.

Figure 19:
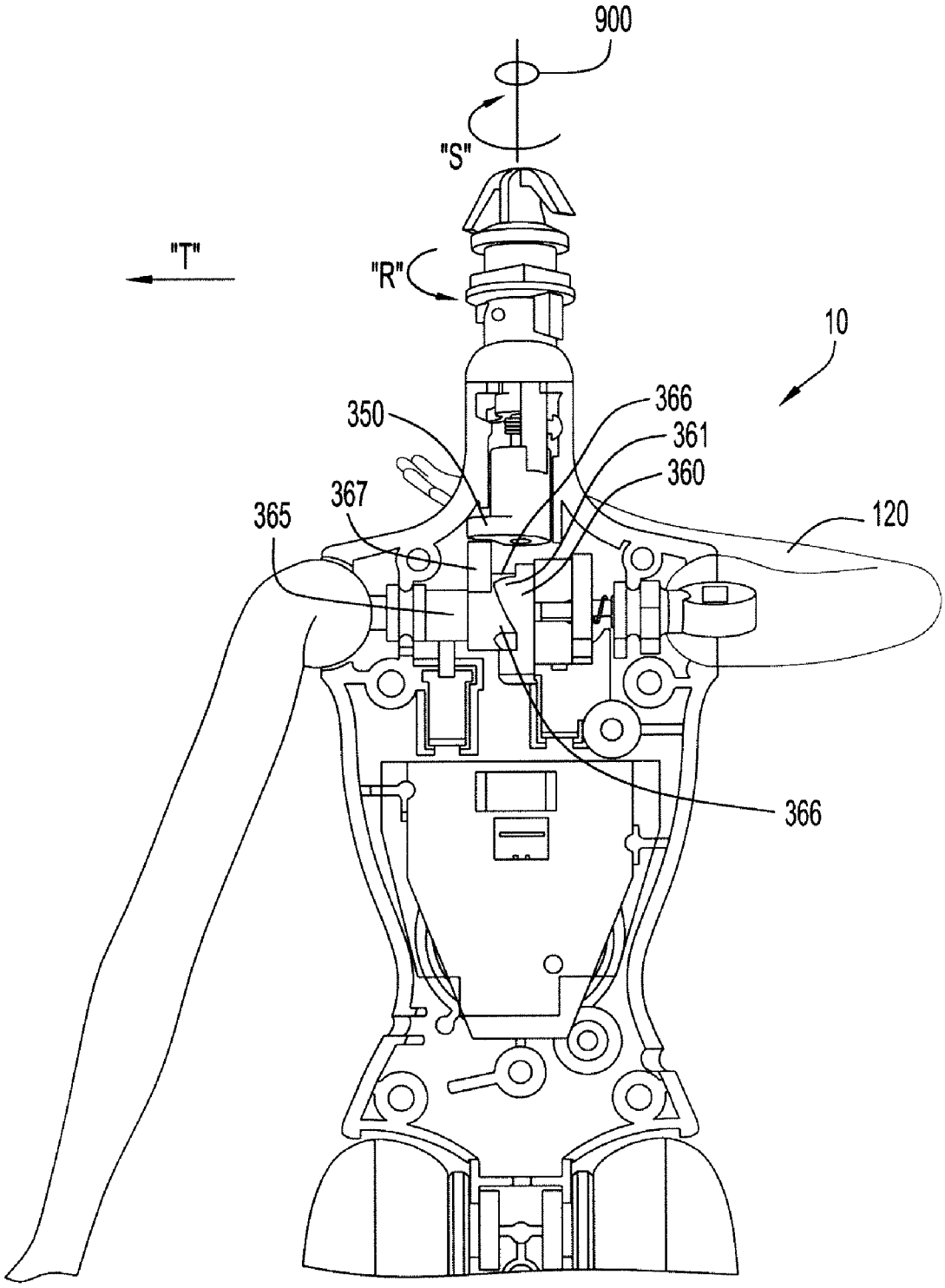

In addition, the surface 375 of the female portion 360 that faces the plate 350 of the first clutch 220 is keyed to receive the plate 350 in a predetermined rotational orientation. As best seen in FIG. 19, the female portion 360 includes several teeth 361 and the male portion 365 includes at least one tooth 366. Referring back to FIG. 13, the female portion 360 of the second clutch 225 includes a cam 380 that is configured to engage the neck assembly, as discussed in greater detail below. Similarly, the male portion 365 of the second clutch 225 includes a cam 367 that has a height that is greater than the diameter of the remainder of the male portion 365. In operation, the female portion 360 of the second clutch 225 and the plate are adapted to slide along the shaft 345, with the biasing member 355 urging not only the plate 350 into engagement with the female portion 360, but also the female portion 360 into engagement with the male portion 365.

Figure 16:
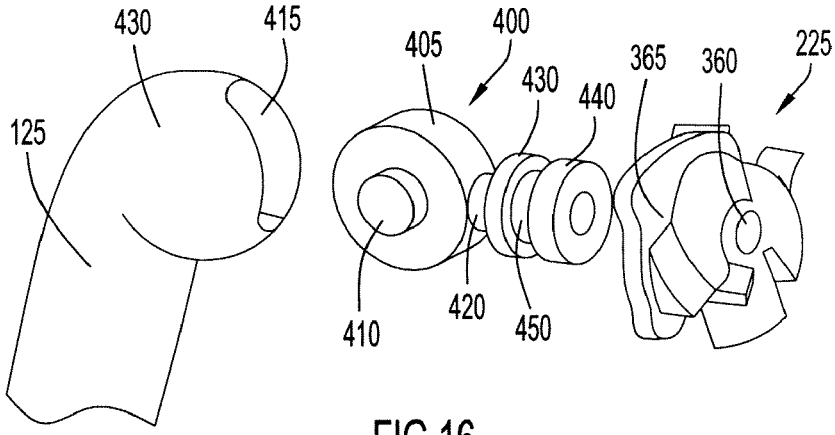

Referring FIG. 16, the male portion 365 of the second clutch 225 is coupled to an arm connector 400 secured to the second arm 125. The arm connector 400 includes a disk-shaped flange 405 having posts 410 extending axially therefrom on opposite sides. The disk-shaped flange 405 mates with a slot 415 formed in the upper end of the second arm 125 (i.e., formed into the shoulder ball 430). A post 420 extends radially from the disk-shaped flange 400 (toward the male portion of the second clutch). The post 420 includes an outer flange 430 and an inner flange 440 that collectively form a guide rail 450. The guide rail 450 receives tabs formed into the front and rear sections of the torso (discussed in greater detail below).

Figure 17:
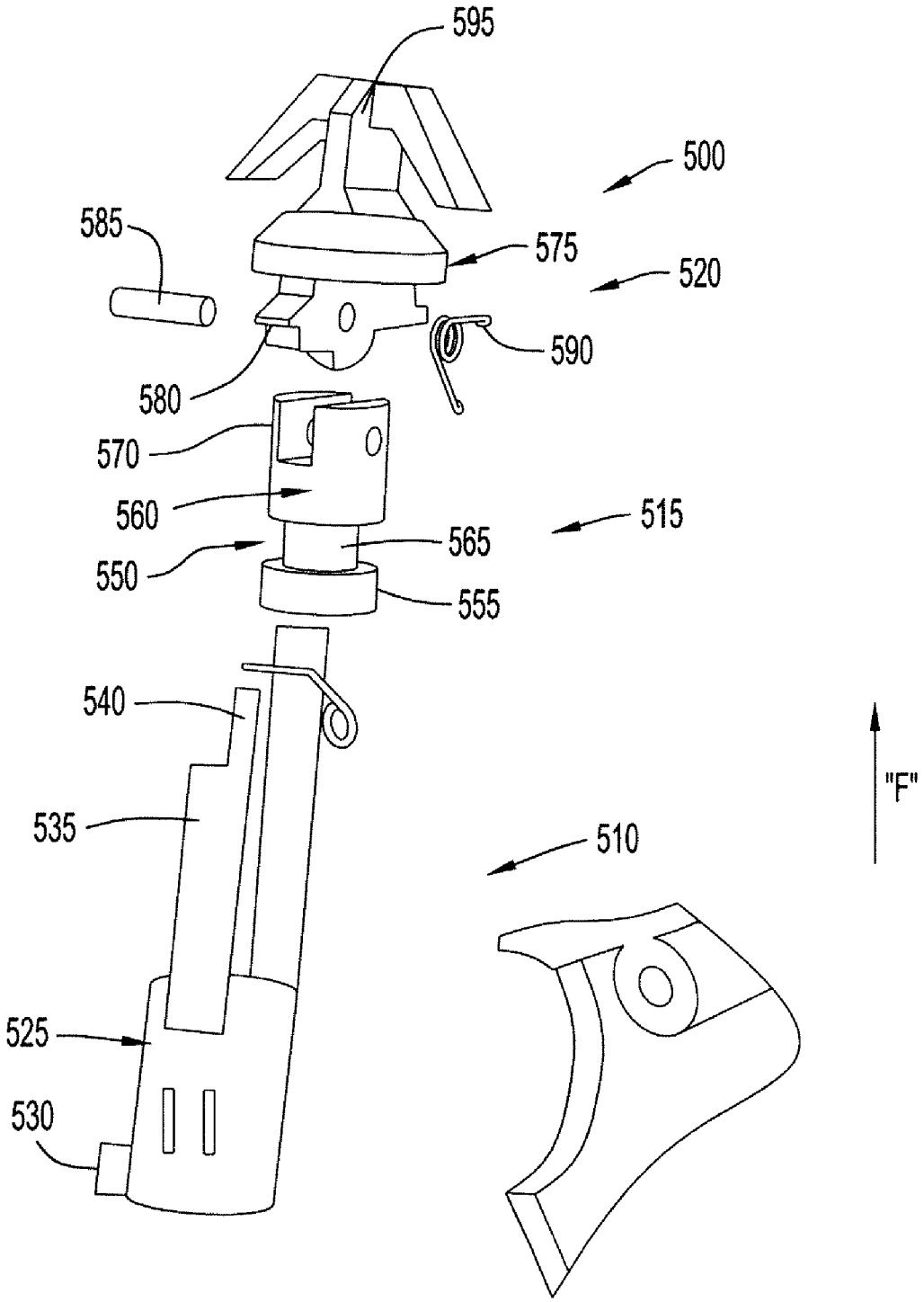

The torso 100 houses a neck assembly configured to generate a canting/nodding motion of the head of the toy figure. Referring to FIG. 17, the neck assembly 500 includes a pulley 510, a lower neck connector 515, and an upper neck connector 520. The pulley 510 includes a generally cylindrical base 525 having a cam 530 extending radially from a side surface thereof proximate the lower end of the base 525. A post 535 extends upward from the base 525 and a pin 540 extends upward from the post 535.

The lower neck connector 515 slidably engages the pulley 510. The lower neck connector 515 includes a central shaft 550 including a cam 555 disposed along its lower end. A socket 560, spaced from the cam 555, is disposed along its upper end. The cam 555 is longitudinally spaced from the socket 560 to define a guide rail 565 that receives tabs formed in the neck portion of the torso. The socket 560 includes a cut-out area 570 configured to receive the pin 540 and post 535, permitting the axial movement of the post and pin within the cut-out area.

The upper neck connector 520 is pivotally coupled to the lower neck connector. The lower neck connector includes a base 575 including a ramp 580. The ramp 580 is positioned within the socket 560 of the lower neck connector 515, and is rotatably connected within the socket 560 via a pin 585. The upper neck connector 520 is spring biased into a normal, upright position via neck spring 590. The upper neck connector 520 further includes a head post 595 that captures the head of the toy figure thereto.

In operation, when an upward force is applied to the pulley 510 (indicated by arrow F), the pulley is driven upward, causing the post 535 to travel through the cut-out area 570 of the lower neck connector 515 until the pin 540 of the lower neck connector 515 engages the ramp 580 on the upper neck connector 520. The upward movement of the pin 540 contacts the ramp 580, pivoting the upper neck connector 520 forward around the pin 590. Specifically, the upper neck connector 520 is tilted forward, from a first position, in which the axis of the upper neck connector 520 is substantially aligned with the axis of the lower neck connector 515, to a second position, in which the axis of the upper neck connector 520 is not aligned with the axis of the lower neck connector 515.

Figure 18:
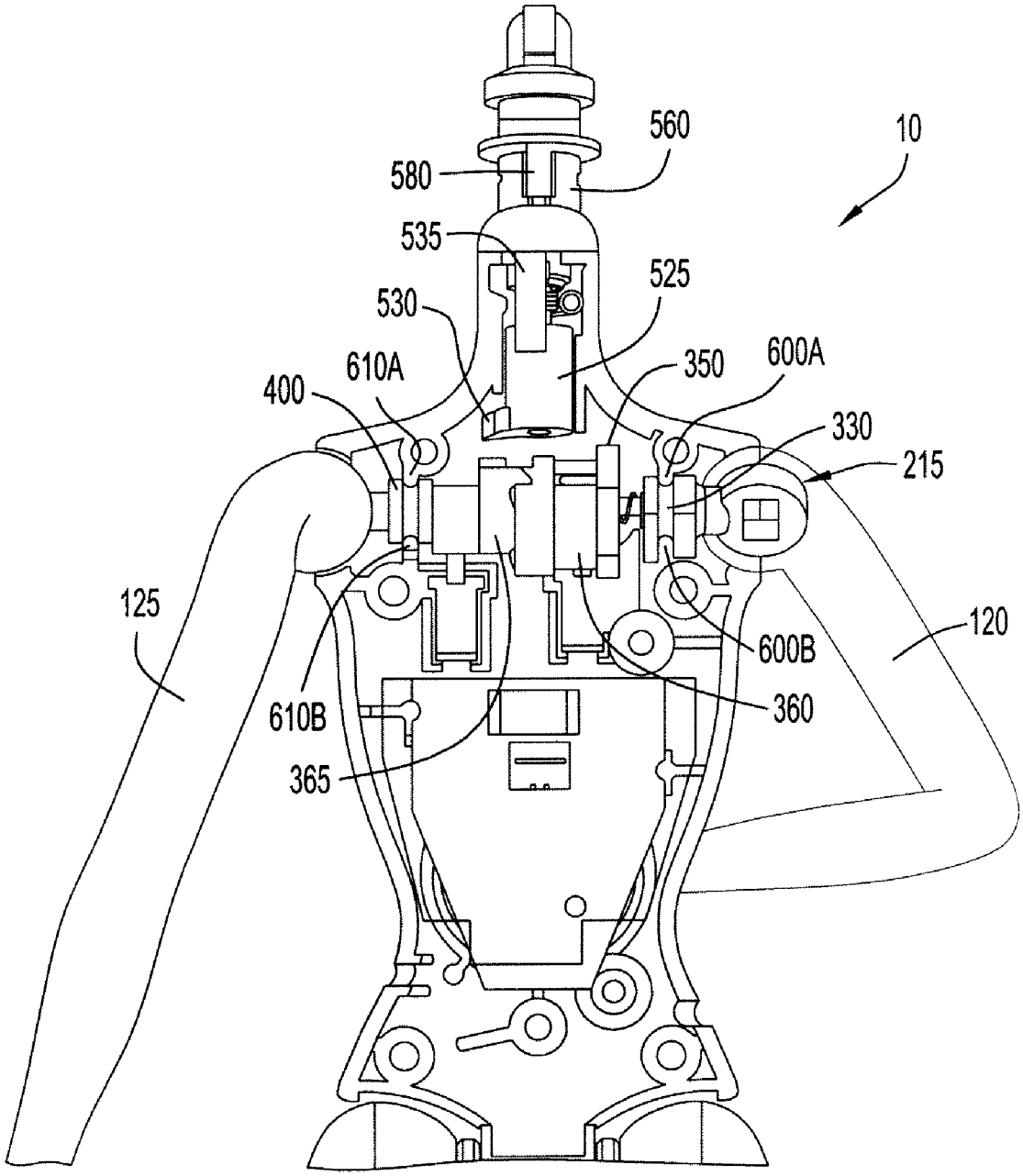
FIGS. 18-20 illustrate internal views of the components of the toy figure illustrated in FIG. 12 in a first configuration, a second configuration, and a third configuration, respectively.

The operation of the device is explained with reference to FIGS. 18-20. Referring to FIG. 18, the toy FIG. 10 begins in a first, normal position, in which the first arm 120 is oriented in a lowered position. As shown, the front section 205 of the torso 100 includes a first pair of opposed tabs 600A, 600B, collectively forming a U-shape, define the movement of guide rail 330 of the arm gear 215, thereby permitting rotation of the arm gear 215 while preventing lateral movement. Similarly, arm connector 400 is positioned within a U-shaped guide formed with opposed tabs 610A, 610B, which permit the rotational movement, but prevent the lateral movement of the arm connector 400.

In operation, rotating the first arm 120 upward can generate a head turning or a head nodding movement, depending on the configuration of the movement mechanism 200. Referring to FIG. 19, moving the first arm 120 from its lowered position to its raised position rotates the second clutch 225 to position the cam 367 on the male portion 365 of the second clutch 225 into engagement with the cam 530 on the base 525. Referring to FIG. 19, this engagement rotates the neck assembly 500 along the direction of arrow "R" about a generally vertical axis 900, thereby turning or rotating the head of the toy figure to the side so that it faces along the direction of arrow "T." When the arm or appendage 120 is rotated downward, the cam 367 moves the cam 530 in the opposite direction, thereby rotating the head along the direction of arrow "S" from its side position to its forward oriented position.

In this embodiment, each rotation of the arm 120 upwardly causes the male portion 365 of the second clutch 225 to move approximately 90 degrees or a quarter of a rotation. The male portion 365 engages the female portion 360 and causes the female portion 360 to rotate the same amount. When the arm 120 is rotated downward, the male portion 365 slides along the surface of the female portion 360 and the female portion 360 does not rotate. When the arm 120 is cycled again through its upward and downward movement, the female portion 360 is moved another 90 degrees. Similarly, when the arm 120 is cycled again through its upward and downward movement, the female portion 360 is moved another 90 degrees.

As described above, on the fourth cycle of appendage or arm movement, the head of the toy figure is tilted or canted forward instead of turning to the side. Thus, as the female portion 360 of the second clutch 225 is advanced or rotated by the fourth movement of the arm 120 upward, the head of the toy figure is canted or tilted forward.

Figure 20:
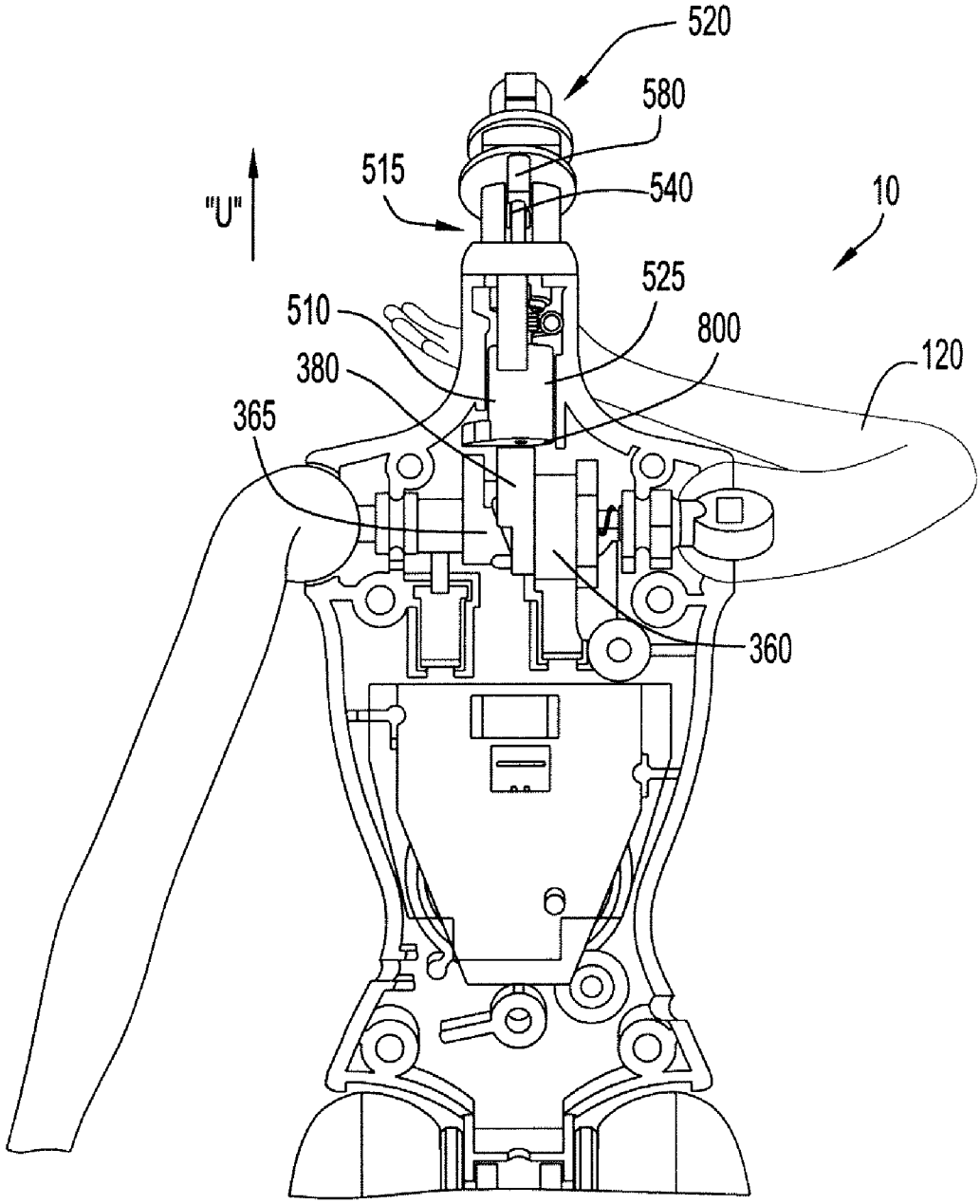

Referring the FIG. 20, rotating the first arm 120 upward from its lowered position a fourth time results in the female portion 360 of the second clutch 225 to be rotated so that the cam 380 on the female portion 360 engages the bottom surface 800 of the base 525. The based 525 is driven upward along the direction of arrow "U," sliding through the cut-out area 570 of the lower neck connector 515 as described above. As explained above, the upward driven base and pulley causes the pin 540 disposed on the shaft 535 to engage the ramp 580 on the upper neck connector 520. The upper neck connector 520, which supports the head of the toy figure, is pivoted forward, toward the front section 205 of the torso 100. As a result, a nodding/tilting motion is generated.

In an alternative embodiment, the tilting forward of the head can occur on the second, third, or any subsequent movement of the appendage from its lowered position to its raised position, depending on the rotation of the clutches of the movement mechanism.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

What is claimed is:

1. A toy figure, comprising:

a torso;

a head coupled to the torso, the head being movable between a first position, a second position, and a third position relative to the torso;

an appendage coupled to the torso, the appendage being movable between a first position and a second position relative to the torso; and a mechanism disposed within the torso and coupled to the appendage, a first movement of the appendage from its first position to its second position causing the mechanism to move the head from its first position to its second position where the head returns to its first position when the appendage is moved from the second position to the first position, and a second movement of the appendage from its first position to its second position causing the mechanism to move the head from its first position to its third position where the head returns to its first position when the appendage is moved from the second position to the first position.

2. The toy figure of claim 1, wherein the head in the first position is oriented forward relative to the torso and the head in the second position is oriented toward a side of the torso.

3. The toy figure of claim 2, wherein the head in the third position is tilted forward relative to the torso.

4. The toy figure of claim 1, wherein the appendage in its first position is in a lowered position and the appendage in its second position is in a raised position.

5. The toy figure of claim 1, wherein the mechanism includes an axle with a first clutch coupled thereto, a second clutch rotatably mounted on the axle, and a movement member engaged with the head, the first clutch and the second clutch engaging each other, and the second clutch engaging the movement member.

6. The toy figure of claim 5, wherein the second clutch is biased into engagement with the first clutch.

7. The toy figure of claim 5, wherein the first clutch includes a tooth and the second clutch includes a plurality of teeth, the tooth of the first clutch engaging one of the teeth of the second clutch to rotate the second clutch relative to the axle.

8. The toy figure of claim 7, wherein the second clutch includes an extension portion, the extension portion having a diameter greater than the rest of the second clutch, the extension portion engaging the movement member as the first clutch rotates the second clutch during the second movement of the appendage, the engagement of the movement member by the extension portion moving the head from its first position in which it is oriented forwardly to its second position in which it is tilted forwardly.

9. The toy figure of claim 1, wherein the appendage includes a toy object coupled thereto, the head being disposed proximate to the toy object when the head is located in its third position.

10. The toy figure of claim 9, wherein the head in its third position is tilted forward so that the toy figure appears to be kissing the toy object.

11. The toy figure of claim 1, wherein the movement of the appendage from the second position of the appendage to the first portion of the appendage causes the head to move from either of the second position of the head or the third position of the head to the first position of the head.

12. The toy figure of claim 5, wherein the movement member includes a pulley, a lower connector, and an upper connector, and an upward force applied to the pulley causes the pulley to contact the upper connector, tilting the head forward.

13. The toy figure of claim 7, wherein the second clutch includes an extension portion, the extension portion having a diameter greater than the rest of the second clutch, the extension portion engaging the movement member as the first clutch rotates the second clutch during the second movement of the appendage, the engagement of the movement member by the extension portion moving the head from its first position in which it is oriented forwardly to its second position in which it is oriented toward a side of the torso.

14. A toy figure with a movable head, comprising:

a torso;

a head coupled to the torso, the head being disposable in a forward position in which the head is looking forward relative to the torso, a side position in which the head is oriented to a side of the torso, and a tilted position in which the head is tilted downward relative to the torso; and an actuator coupled to the torso, the actuator being movable between a first position and a second position, and subsequent movements of the actuator from its first position to its second position cause the head to move from its forward position to its side position and from its forward position to its tilted position, and movements of the actuator from its second position to its first position cause the head to move from either its side position to its forward position or from its tilted position to its forward position.

15. The toy figure of claim 14, wherein the actuator is an appendage of the toy figure, the first position is a lowered position, and the second position is a raised position.

16. The toy figure of claim 15, wherein the appendage includes a toy character coupled thereto, the head in its tilted position being disposed proximate to the toy character.

17. The toy figure of claim 16, wherein the head in its tilted position appears to be kissing the toy character.

18. The toy figure of claim 14, wherein the movement of the actuator from its second position to its first position causes the head to move from its tilted position to its forward position.

19. A toy figure, comprising:

a torso;

a head movably coupled to the torso; and an appendage movably coupled to the torso, the appendage being coupled to the head via an actuator such that movement of the appendage relative to the torso causes the head to move relative to the torso, the head and the appendage being disposable in a first configuration in which the appendage is lowered and the head is oriented forward relative to the torso, a second configuration in which the appendage is raised and the head is oriented to a side of the torso until the appendage is lowered, and a third configuration in which the appendage is raised and the head is tilted forward and located proximate to the appendage until the appendage is lowered.

20. The toy figure of claim 19, wherein movement of the appendage from a lowered position to a raised position causes the head to move from its forward orientation to one of its side orientation or its tilted orientation.

* * * * *